US010079081B2

(12) United States Patent
Gareis

(10) Patent No.: US 10,079,081 B2
(45) **Date of Patent: *Sep. 18, 2018**

(54) LOW R, L, AND C CABLE

(71) Applicant: Belden Inc., St. Louis, MO (US)

(72) Inventor: Galen Mark Gareis, Oxford, OH (US)

(73) Assignee: BELDEN INC., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/451,003

(22) Filed: Mar. 6, 2017

(65) Prior Publication Data

US 2017/0178767 A1 Jun. 22, 2017

Related U.S. Application Data

(63) Continuation of application No. 13/963,570, filed on Aug. 9, 2013, now Pat. No. 9,589,704.

(51) Int. Cl.
*H01B 7/00* (2006.01)
*H01B 7/30* (2006.01)
(Continued)

(52) U.S. Cl.
CPC ..... *H01B 7/306* (2013.01); *H01B 3/445* (2013.01); *H01B 11/12* (2013.01); *H01B 13/0271* (2013.01)

(58) Field of Classification Search
CPC . H01R 7/02; H01R 7/06; H01R 7/306; H01R 7/30
(Continued)

(56) References Cited

U.S. PATENT DOCUMENTS 448,604 A * 3/1891 Conner ..... H01B 11/002 174/121 R
452,340 A * 5/1891 Conner ..... H01B 7/285 156/51
(Continued)

FOREIGN PATENT DOCUMENTS

DE 29516904 U1 2/1996
DE 19648919 A1 5/1998
(Continued)

OTHER PUBLICATIONS

Anonymous, et al: "V-Cables. Speaker Cables (Part I)—How I built them . . . ", Jul. 14, 2013, XP055156523, Internet, Retrieved from the Internet: URL:http://hiend-audio.com/2013/07/14/post-v-cables-speaker-cables-1/[retrieved on Mar. 12, 2014] paragraphs "Raw materials" and "The quantity of materials that shall actually be used"; figure on p. 1, 14 pages.
(Continued)

*Primary Examiner* — William H Mayo, III
(74) *Attorney, Agent, or Firm* — Daniel Rose; Foley & Lardner LLP

(57) ABSTRACT

A cable having low values for resistance, inductance, and capacitance. The cable includes a plurality of conductors for each signal or leg, which may be configured as a braid of three subsets of braids of bonded pairs of insulated conductors. The bonded pairs may be twisted or untwisted, in close proximity such that inductance is reduced via magnetic field cancellation. Each leg may be separate and parallel, rather than interwoven or braided together, increasing the distance between the two signals and reducing capacitance. The legs may be positioned close to each other, such that their magnetic fields cancel to further reduce inductance.

16 Claims, 11 Drawing Sheets

(51) Int. Cl.
*H01B 13/02* (2006.01)
*H01B 11/12* (2006.01)
*H01B 3/44* (2006.01)

(58) Field of Classification Search
USPC ..... 174/28, 29, 36, 102 R, 110 R, 113 R, 174/108, 109, 33, 34
See application file for complete search history.

(56) References Cited

U.S. PATENT DOCUMENTS

| | | | | | |
|---|---|---|---|---|---|
| 2,958,724 | A | | 11/1960 | Henry | |
| 3,067,569 | A | * | 12/1962 | Kelley, Jr. | H01B 7/0009 156/166 |
| 3,815,054 | A | * | 6/1974 | McClure | H01P 5/00 174/113 R |
| 4,777,324 | A | * | 10/1988 | Lee | H01B 7/0009 174/113 R |
| 5,110,999 | A | * | 5/1992 | Barbera | H01B 11/12 174/107 |
| 5,298,680 | A | * | 3/1994 | Kenny | H01B 11/04 174/34 |
| 5,376,758 | A | * | 12/1994 | Kimber | H01B 11/12 174/113 C |
| 5,659,152 | A | * | 8/1997 | Horie | H01B 11/04 174/113 R |
| 5,821,467 | A | * | 10/1998 | O'Brien | H01B 7/40 174/117 AS |
| 6,066,799 | A | | 5/2000 | Nugent | |
| 6,211,467 | B1 | * | 4/2001 | Berelsman | H01B 7/1895 174/113 C |
| 6,215,062 | B1 | | 4/2001 | Kimber | |
| 6,259,031 | B1 | | 7/2001 | Totland et al. | |
| 6,476,328 | B2 | * | 11/2002 | Agostinelli | H01B 11/12 174/113 R |
| 7,078,626 | B2 | * | 7/2006 | Somers | H01B 11/02 174/113 R |
| 7,141,740 | B2 | * | 11/2006 | Ko | H04R 1/06 174/128.1 |
| 8,119,917 | B2 | | 2/2012 | King | |
| 2002/0092668 | A1 | | 7/2002 | Groegl et al. | |
| 2006/0081388 | A1 | | 4/2006 | Spath | |

FOREIGN PATENT DOCUMENTS

| | | | | |
|---|---|---|---|---|
| WO | WO-2008/138025 | | 11/2008 | |
| WO | WO 2008138025 | A2 * | 11/2008 | H01B 11/12 |
| WO | WO-2011/031238 | | 3/2011 | |

OTHER PUBLICATIONS

Anonymous, et al: "V-Cables. Speaker Cables (Part III)—how I enjoy them . . . ", Jul. 17, 2013, XP055156528, Internet, Retrieved from the Internet: URL:http://hiend-audio.com/2013/07/17/post-v-cables-speaker-cables-3/[retrieved on Dec. 3, 2014] last paragraph, figures 3x3 twisted pair braid, 3x twisted pair braid, 11 pages.
Goldsworthy, Thomas, Speaker Cable Faceoff 3—The DIY Shootout, taken from www.audioholics.com/reviews/cables/diy-speaker-cable-faceoff, dated Apr. 30, 2005, 6 pages.
International Preliminary Report on Patentability on PCT/US2014/050145 dated Feb. 18, 2016.
International Search Report and Written Opinion for International Application No. PCT/2014/050145 dated Dec. 15, 2014, 14 pages.
Kimber Kable, taken from http://www.kimber.com/products/loudspeakercables/tc/4/ on Nov. 8, 2013, dated Jan. 13, 2010, 3 pages.
Loesch, Thorsten, TNT-Audio, The "Full Frequency Range Cable", taken from www.tnt-audio.com/clinica/ffrc_e.html on May 23, 2013, dated 1999, 4 pages.
McCall, Adam, DIY AUdio Projects: Low-Inductance DIY Hi-Fi Speaker Cables, taken from www.diyaudioprojects.com, dated Feb. 13, 2012, 5 pages.
Nagaraj, Sreekanth, DIY Audio Projects: DIY Braided Speaker Cables, taken from www.diyaudioprojects.com, dated Feb. 23, 2012, 3 pages.
Nagaraj, Sreekanth; "DIY Braided Speaker Cables", Feb. 23, 2012, XP055156517, Internet, Retrieved from the Internet: URL:http://diyaudioprojects.com/Power/DIY-Braided-Speaker-Cables/[retrieved on Dec. 3, 2014] the whole document, 3 pages.
Notice of Allowance on U.S. Appl. No. 13/963,570 dated Oct. 25, 2016.
Office Action on U.S. Appl. No. 13/963,570 dated Jun. 11, 2015.
Office Action on U.S. Appl. No. 13/963,570 dated Apr. 29, 2016.
Office Action on U.S. Appl. No. 13/963,570 dated Oct. 7, 2015.

* cited by examiner

LOW R, L, AND C CABLE

RELATED APPLICATIONS

The present application claims the benefit of and priority as a continuation to U.S. patent application Ser. No. 13/963,570, entitled "Low R, L, and C Cable," filed Aug. 9, 2013, and issued as U.S. Pat. No. 9,589,704 on Mar. 7, 2017, the entirety of which is hereby incorporated by reference.

FIELD

The present application relates to audio cables. In particular, the present application relates to a cable having low resistance, inductance, and capacitance.

BACKGROUND

At audio frequencies (i.e. between roughly 20 Hz to 20 kHz), passive transmission lines, such as speaker cables, may be considered equivalent to a simple circuit, as shown in FIG. 1A, with a cable 102 between an amplifier 100 or other signal source, and a speaker 104 or other signal destination. Such cables may be considered a multi-polarity cable, carrying two polarities of a signal, or a signal and reference ground, via two separate legs or conductors (which may comprise one or more individual conductors), as opposed to a single-polarity wire or cable comprising a single leg or conductor. The cable 102 has an internal and inherent resistance R, sometimes referred to as insertion loss; inductance L as combination of self-inductance of an individual conductor or leg and mutual inductance between two conductors; and capacitance C between conductors or separate legs.

High values for resistance, inductance, or capacitance can adversely affect transmission of the signal, in particular affecting high frequency response of the cable 102. However, these values are inter-related: in particular, mutual inductance between two conductors (such as two conductors in a parallel configuration, commonly referred to as zip cord) may be decreased by bringing the conductors closer together, but this increases capacitance between the conductors. Accordingly, typical cables 102 are designed to minimize one of these values, frequently inductance, at the expense of higher capacitance, which is considered to be relatively inaudible at low decibel losses (e.g. less than 3 dB within the audio range).

Unfortunately, beyond adverse effects on frequency response, high capacitance in a cable 102 may cause an amplifier 100 to oscillate at high frequencies, resulting in audible clipping or amplitude limiting of the output audio waveform, non-linear distortion, and potential damage to the amplifier 100. One work around, shown in FIG. 1B, is to include a Zobel network 106*a*-106*b* (sometimes referred to as a constant resistance network), which may be used to damp potentially harmful oscillations. However, the addition of such components add expense and potential for failure.

SUMMARY

The present disclosure describes a cable designed to minimize values for resistance, inductance, and capacitance, without the trade-offs of typical designs. In some implementations, the cable includes a plurality of conductors for each signal polarity or leg, configured as a braid of three subsets of braids of bonded pairs of insulated conductors. The bonded pairs may be twisted or untwisted. The plurality of insulated conductors for each signal act in parallel to reduce overall resistance for the signal, and may be of a high gauge or narrow diameter to utilize the entire skin depth of each conductor and avoid skin effect losses at higher frequencies. The conductors for each signal may be braided such that each conductor crosses others at an angle, which may approach or equal 90 degrees. Because the induced current in a wire due to a magnetic field is proportional to the cosine of the angle between the field direction and wire, as this angle approaches 90 degrees due to the geometry of the braid, the induced current in each conductor approaches 0. Additionally, magnetic fields due to current flow in each pair of conductors may be in opposing directions at positions around the intersection of the conductors and cancel, reducing the net magnetic field. Each conductor may be insulated with a material having a high breakdown voltage, such as fluorinated ethylene propylene (FEP), polytetrafluoroethylene (PTFE) (such as TEFLON®, manufactured by E.I. du Pont de Nemours and Company (DuPont) of Wilmington, Del.), allowing very thin insulating walls, decreasing the distance between each conductor in the braid, thereby reducing inductance. Similarly, the insulating material may have a low dielectric constant, thereby reducing capacitance. Each leg may be separate and parallel, rather than interwoven or braided together, increasing the distance between the two signal conductors, thereby reducing capacitance. Furthermore, because individual conductors within each leg are braided across the diameter of the leg, the average distance between any individual conductor in one leg and any individual conductor in the other leg will be the average distance between the center of each leg. Because the capacitance between the two legs is inversely proportional to their separation, implementations of this design significantly reduces the capacitance of the cable.

The cable may include a covering and/or shield around both legs, such as one or more of a conductive braid, foil shield, or similar electrostatic interference shielding; an insulating rubber, polyvinyl chloride (PVC), thermoplastic elastomer (TPE) jacket or similar jacket or sheath; and/or nylon or other textile braid, plastic spiral wrap, or similar cover. The covering may thus provide passive electrostatic interference rejection, as well as structural support to keep the two signal polarity carrying legs together. Similarly, due to the symmetrical and parallel legs, when used for carrying opposite polarities of a signal, external electromagnetic interference may be rejected or canceled. The cable may be round or substantially round, allowing ease of deployment, superior cable management and durability. In some embodiments, the two legs may be tied or physically held together via textile threads or similar materials woven through gaps between pairs of conductors within each leg. In such embodiments, an external covering may be absent.

In one aspect, the present disclosure is directed to a cable providing low capacitance, low inductance and carrying multiple signal polarities. The cable includes a first leg comprising a first plurality of braided insulated conductors for carrying a first polarity signal. The cable also includes a second leg comprising a second plurality of braided insulated conductors for carrying a second polarity signal. The second plurality of braided insulated conductors may be placed parallel or adjacent to the first plurality of braided insulated conductors, or twisted in a helix with the first plurality of braided insulated conductors. The cable may further include a securing material holding the first leg and second leg together or adjacent, such as a covering and/or shield surrounding the first leg and second leg, or one or more threads woven between the first leg and second leg.

In one embodiment, the first leg and second leg each comprise a braid of three sets of conductors. Each of the three sets of conductors further comprises a braid of three pairs of insulated conductors. In a further embodiment, each pair of insulated conductors comprises a bonded pair of insulated conductors. In another further embodiment, each pair of insulated conductors comprises an untwisted pair of insulated conductors.

In some embodiments, the capacitance between the first plurality of braided insulated conductors and the second plurality of braided insulated conductors is less than 35 pf/foot. In many embodiments, the total loop inductance between the first plurality of braided insulated conductors and the second plurality of braided insulated conductors is less than 0.15 μH/foot.

In one embodiment, the shield comprises a conductive braid surrounding the first leg and the second leg. In another embodiment, the shield comprises a conductive foil surrounding the first leg and the second leg. In yet another embodiment, the covering comprises an insulating jacket surrounding the legs. In still yet another embodiment, the covering comprises a spiral wrap surrounding the legs.

In some embodiments, the first polarity signal is an inverse of the second polarity signal. In many embodiments, the first polarity signal and second polarity signal comprise opposite polarities of an audio signal.

In one embodiment, each conductor has a diameter of approximately 0.018-0.022 inches. In another embodiment, each conductor is surrounded by a fluorinated ethylene propylene (FEP) insulator. In still another embodiment, the cross section of the cable is substantially round.

In another aspect, the present disclosure is directed to a method for constructing a cable providing low capacitance, low inductance and carrying multiple signal polarities. The method includes braiding three pairs of insulated conductors to create a subset of braided conductors. The method also includes braiding three subsets of conductors to create a first leg. The method further includes securing two legs adjacent to each other with a securing material, such as encasing the legs within a covering and/or shield or by binding the legs together via one or more interwoven threads or similar materials. The legs may be in parallel, configured in a helix, or otherwise adjacent.

In one embodiment, the method includes braiding three pairs of insulated conductors and braiding three subsets of conductors simultaneously. In another embodiment, the method includes encapsulating the two legs in a conductive braid. In some embodiments, the capacitance between the two legs is less than 35 pF/foot. In many embodiments, the total inductance of each of the legs is less than 0.15 μH/foot.

BRIEF DESCRIPTION OF THE FIGURES

In the drawings, like reference numbers generally indicate identical, functionally similar, and/or structurally similar elements.

DETAILED DESCRIPTION

Figure 1A:
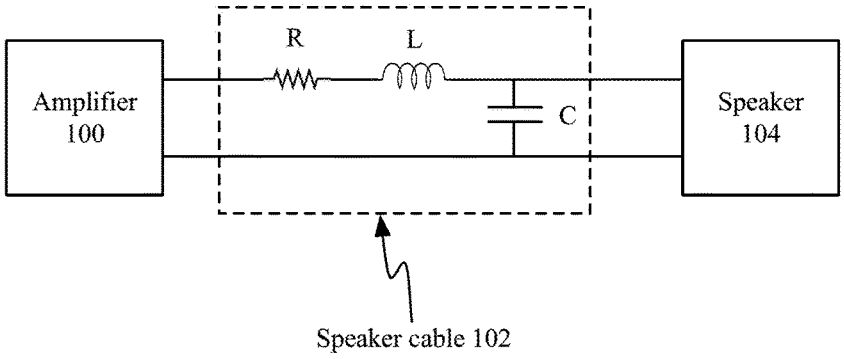
FIG. 1A is a block diagram of an embodiment of an equivalent circuit of a cable between a signal source and signal destination.
Figure 1B:
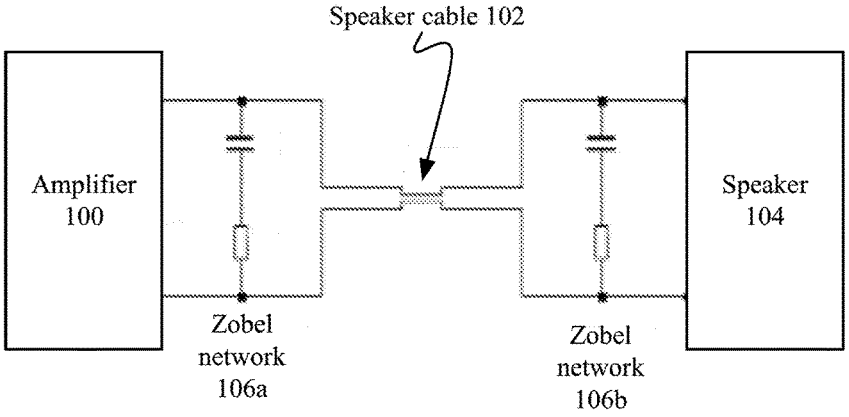
FIG. 1B is a block diagram of an embodiment of a cable deployment including Zobel networks for control of excessive capacitance.

Audio signals are in the range from approximately 20 Hz to approximately 20 kHz, representing four orders of magnitude. While a theoretical cable may have a flat impedance from 0 Hz to very high frequencies (sometimes referred to as "direct current (DC) to light"), in reality, cables carrying said signals may have drastically different responses across this range. For instance, current flow along the conductors generate magnetic fields, and with varying current, the magnetic fields similarly vary, inducing corresponding currents in nearby conductors. These characteristics are frequency dependent, and accordingly, may vary the sound of an audio signal transmitted by the cable, reducing high frequency components or causing audible phase distortion. Because the magnetic fields are proportional to current flow and flux, the effects are further compounded by the low-voltage, high-current signals used for most loudspeakers, which are typically in the range of 0-50 amps into a 4 or 8 ohm load, and can be in the range of 100 amps with high-power audio amplifiers.

One characteristic of a cable is inductance or resistance to current flow, and is a total of self inductance, comprising internal and external inductance, and mutual inductance due to magnetic interactions with other conductors. In many implementations of cables transmitting audio signals, internal inductance may be ignored, as the skin effect at the frequencies involved forces current to the outside of each conductor. Specifically, in a wire carrying DC, there is a uniform current density profile from the center of the wire to the surface. However, at high frequencies, due to the skin effect or self inductance, the current is predominately at or near the outside surface of the conductor. At an infinitely high frequency, the current is forced to the surface of the conductor, and the conductor is equivalent to an infinitely thin cylindrical sheet or tube. At anywhere within such a tube other than the surface, the current field is zero, and accordingly, the internal portion of the wire has no stored energy or inductance. Accordingly, at sufficiently high frequencies and for narrow diameter conductors, the internal inductance may be disregarded. As implementations of a low R, L, and C cable discussed herein may utilize very narrow conductors to reduce skin effect losses, these cables may also benefit from the corresponding reduction in internal inductance at audio frequencies. Thus, neglecting internal inductance, given a total cable length much greater than the inter-conductor spacing, the total self inductance is:

$$K=[\ln(2*l/d)]/[\ln(2*l/r)],$$

with cable length l, conductor separation d, and conductor radius r. However, as the inter-conductor spacing increases, internal inductance may also correspondingly increase. Accordingly, in many implementations, inter-conductor spacing is minimized to minimize total cable inductance. At low to mid frequencies, the total inductance may be calculated as:

$$L_{Total}=0.281*\mathrm{Log}(d/r)+L_{i1}+L_{i2},$$

with space between conductors d, conductor radius r, and internal inductance of each conductor $L_{i1}$, $L_{i2}$. Generally, most high-end audio cables have less than 0.150 μH/ft. of inductance. Typical values for inductance are listed below in Table 1:

TABLE 1

| Cable type | Ω/ft. | pF/ft. | μH/ft. |
|---|---|---|---|
| 24 ga. Zip (multi-strand twin-lead cable) | 0.05 | 16 | 0.24 |
| 18 ga. Zip | 0.014 | 28 | 0.21 |
| Lucas cable, from S.O.T.A. of Halifax, Canada (approximately 14 ga. ribbon cable) | 0.0055 | 20 | 0.25 |
| MONSTER CABLE ®, manufactured by Monster Cable Products of Brisbane, California, with sample obtained from Audio Sales Associates of San Francisco, California (approximately 12 ga. multi-strand twin lead) | 0.0034 | 24 | 0.21 |
| Fulton "Gold" cable, from Fulton Musical Industries of Minneapolis, Minnesota (4 ga. multi-strand twin lead) | 0.001 | 28 | 0.19 |
| Polk Sound Wire, from Polk Audio of Baltimore, Maryland (multiple interwoven insulated conductors) | 0.0075 | 500 | 0.026 |
| Mogami W3082 speaker cable, from Mogami Cable of El Segundo, CA (coaxial multi-strand cable with plastic core) | 0.0027 | 77 | 0.12 |
| AUDIOSOURCE ® High Definition Wire, from AudioSource of Portland, Oregon (8 twisted pairs of wire arranged in a flat ribbon) | 0.013 | 280 | 0.037 |
| AUDIOSOURCE ® Ultra-High Definition Wire, from AudioSource of Portland, Oregon (multiple interwoven insulated conductors) | 0.012 | 600 | 0.029 |

Sources: "Speaker Cables: Science or Snake Oil" by Nelson Pass, Speaker Builder magazine (1980) available at https://passlabs.com/articles/speaker-cables-science-or-snake-oil; W3082 speaker cable characteristics, Mogami Cable (Dec. 28, 2010) available at http://www.mogami-cable.com/category/bulk/speaker_cable/pure_sound/

Inductance is also related to the geometry of the conductors, through phase cancellation of magnetic waves. Two positive leads side by side with current flow in the same direction each generate magnetic fields that, at a point between the leads, are equal and in the opposite direction, canceling each other. Similarly, a positive and negative lead side by side generate equal magnetic fields in the same direction, increasing the resulting field strength. As noted above, some cables may use interwoven wires to have conductors crossing at angles, reducing the total inductance compared to parallel and opposing leads. However, as discussed in more detail below, this may significantly increase capacitance (see, e.g., Polk Sound Wire and AUDIOSOURCE® Ultra-High Definition Cable in Table 1).

Another characteristic of cables is capacitance, or ability to store electric charge. Capacitance between separate conductors having different potentials or separate legs of a cable, sometimes referred to as parasitic or stray capacitance, may cause problems at high frequencies, significantly increasing impedance of the circuit and reducing high frequency performance. Additionally, high capacitance between legs of a cable connected to an amplifier, such as in a speaker cable, may act as a positive feedback path, causing the amplifier to oscillate at high frequency. These parasitic oscillations may cause audible distortion and clipping of the amplifier output signal, as well as potentially causing damage to the amplifier.

Parasitic capacitance is inversely proportional to the distance between the separate legs of the cable. However, as discussed above, inductance is proportional to the distance between the conductors. Accordingly, cables designed with interwoven signal legs to reduce inductance, such as the Polk and AudioSource examples of Table 1, may have very high capacitance. Designers of such cables may accept such high capacitance values in exchange for correspondingly low inductances, as effects due to high inductance may be more audible. However, to prevent amplifier oscillations and damage, designers must typically add Zobel networks, or low-pass impedance matching filters, at some additional expense and potential for failure.

While amplifier damage may be prevented through filters, oscillation is not the only result of high capacitance. In particular, high capacitance may cause phase shift, which, when greater than approximately 10 degrees, may be audible within audio frequencies. Although all cables have some inherent capacitance, the frequency at which this 10 degree point occurs is inversely proportional to the amount of capacitance. Specifically, the combination of parasitic capacitance C between legs of a cable and the total resistance R of the cable may act as a low-pass filter (for example, the effective RLC circuit of FIG. 1A). The resulting response of the cable may be substantially flat at low or mid frequencies and decrease at high frequencies, with a −3 dB point or cut-off or corner frequency $f_c=1/(2\pi RC)$. At the cut-off frequency $f_c$, the cable will have 45 degrees of phase shift. Phase shift φ at other frequencies f may be calculated as $\varphi=-\arctan(2\pi fRC)$. Accordingly, low-inductance, high-capacitance cables may have audible phase distortion. For example, given a 47 nF/ft. speaker cable of a long length of 213 feet (not unusual for larger venues such as movie theaters, arenas, large churches, etc.) with an equivalent resistance of 1.59 ohms, there are 45 degrees of phase shift at 10 kHz, with 10 degrees of phase shift at only 1750 Hz, easily within the audible range.

The low R, L, and C cable described herein addresses these competing requirements of inductance and capacitance, avoiding the trade-offs inherent in typical cables, without requiring the use of additional filters or Zobel networks. The cable utilizes a plurality of conductors for each signal leg, interwoven to reduce inductance, but with legs separated to reduce mutual capacitance. FIGS. 2A-2E and 3 and the accompanying description below describe various embodiments of low inductance and capacitance cables. Drawings in FIGS. 2A-2E are not drawn to scale, but may be enlarged to clearly illustrate various features. FIGS. 4A-4F and 5A-5C and the accompany description below illustrate experimental results of measurements of various reference cables and industry standard designs, and measurements of embodiments of the low inductance and capacitance cables.

Figure 2A:
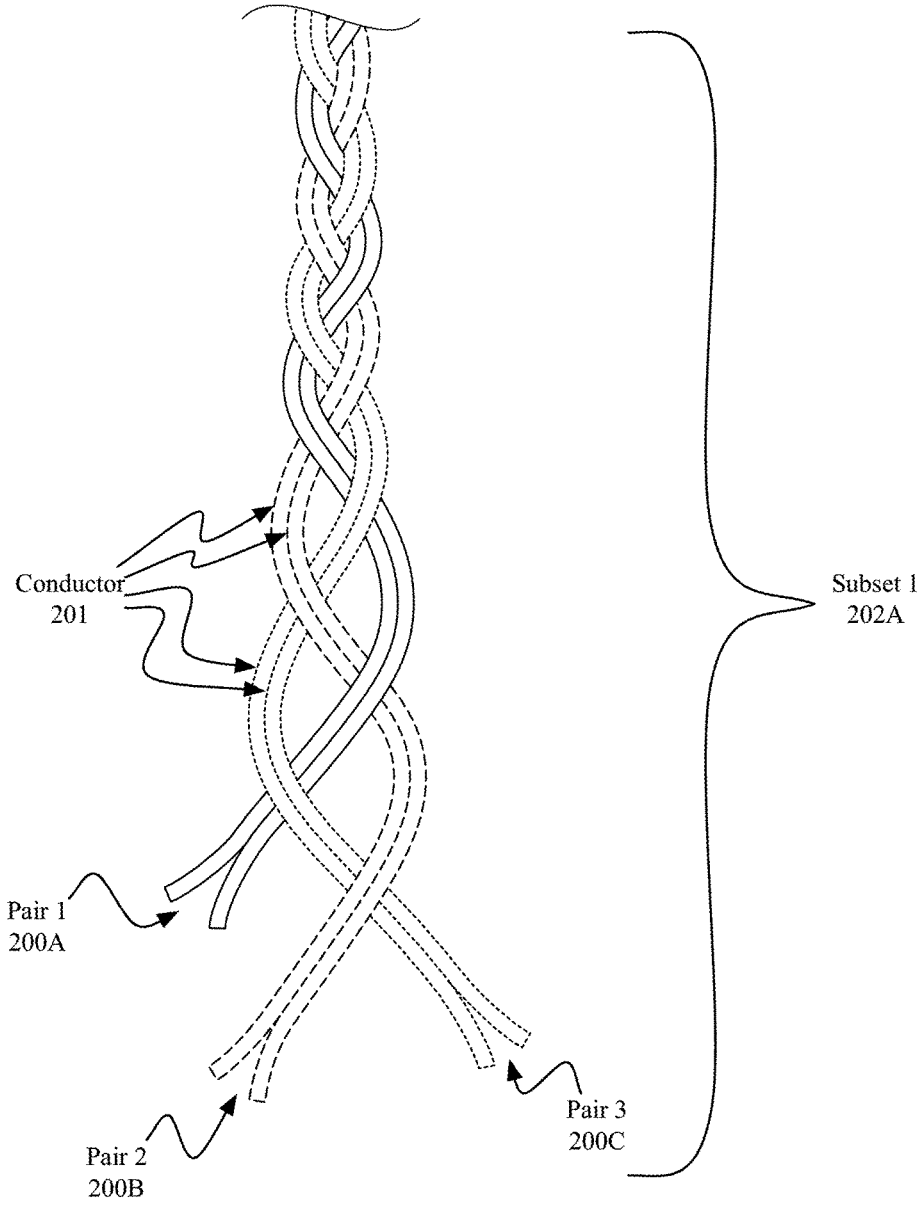
FIG. 2A is a diagram of an embodiment of a braid of three bonded pairs of conductors to form a subset for a low resistance, inductance, and capacitance cable.

Referring first to FIG. 2A, illustrated is a diagram of an embodiment of a braided subset 202A (referred to generally as a subset 202) of three bonded pairs 200A-200C (referred to generally as pair(s) 200) of conductors 201 (referred to generally as conductor(s) 201) for a low resistance, inductance, and capacitance cable. Each pair 200 may comprise a bonded pair of individually insulated conductors, and may be parallel as shown, or may be twisted. In some embodiments, pairs may be unbonded and twisted to minimize spacing between members of the pair. The conductors 201 may be solid or stranded, and may typically have very small diameters, such as 22, 23, 24, 25 or higher American Wire Gauge (AWG) size (e.g. 0.0253 to 0.0159 inches, or smaller). In implementations with twisted pairs, the twists of each pair 200 may be of the same or different twist rates, and may be tight or loose (e.g. one complete twist per inch of conductor length, two complete twists per inch, one twist per two inches, etc.). Twisting the pairs may reduce total inductance while increasing total capacitance.

Each conductor 201 may comprise copper or oxygen-free copper (i.e. having a level of oxygen of 0.001% or less) or any other suitable material, including Ohno Continuous Casting (OCC) copper or silver. Each conductor 201 may be insulated with any type or form of insulation, including polyvinyl chloride (PVC), fluorinated ethylene propylene (FEP) or polytetrafluoroethylene (PTFE) TEFLON®, high density polyethylene (HDPE), low density polyethylene (LDPE), polypropylene (PP), or any other type of insulation. The insulation around each conductor 201 may have a low dielectric constant (e.g. 1-3) relative to air, reducing capacitance between conductors. The insulation may also have a high dielectric strength, such as 400-4000 V/mil, allowing thinner walls to reduce inductance by reducing the distance between the conductors.

As shown in FIG. 2A, each pair 200A-200C may be woven or braided to form a subset 202. Although illustrated with decreasing tightness towards the ends of pairs 200A-200C for clarity, in practice, the subset may be uniformly tight along substantially the entire length of the cable, excepting the terminal portion of each end. The subset may comprise a simple braid or plait as shown. Although illustrated with three pairs 200A-200C, in some embodiments, additional pairs 200 may be added to the subset, and the subset may have any type of regular or complex topology. The overall subset 202 may be flat or substantially flat, round, or have an oval or semi-circular cross section.

Figure 2B:
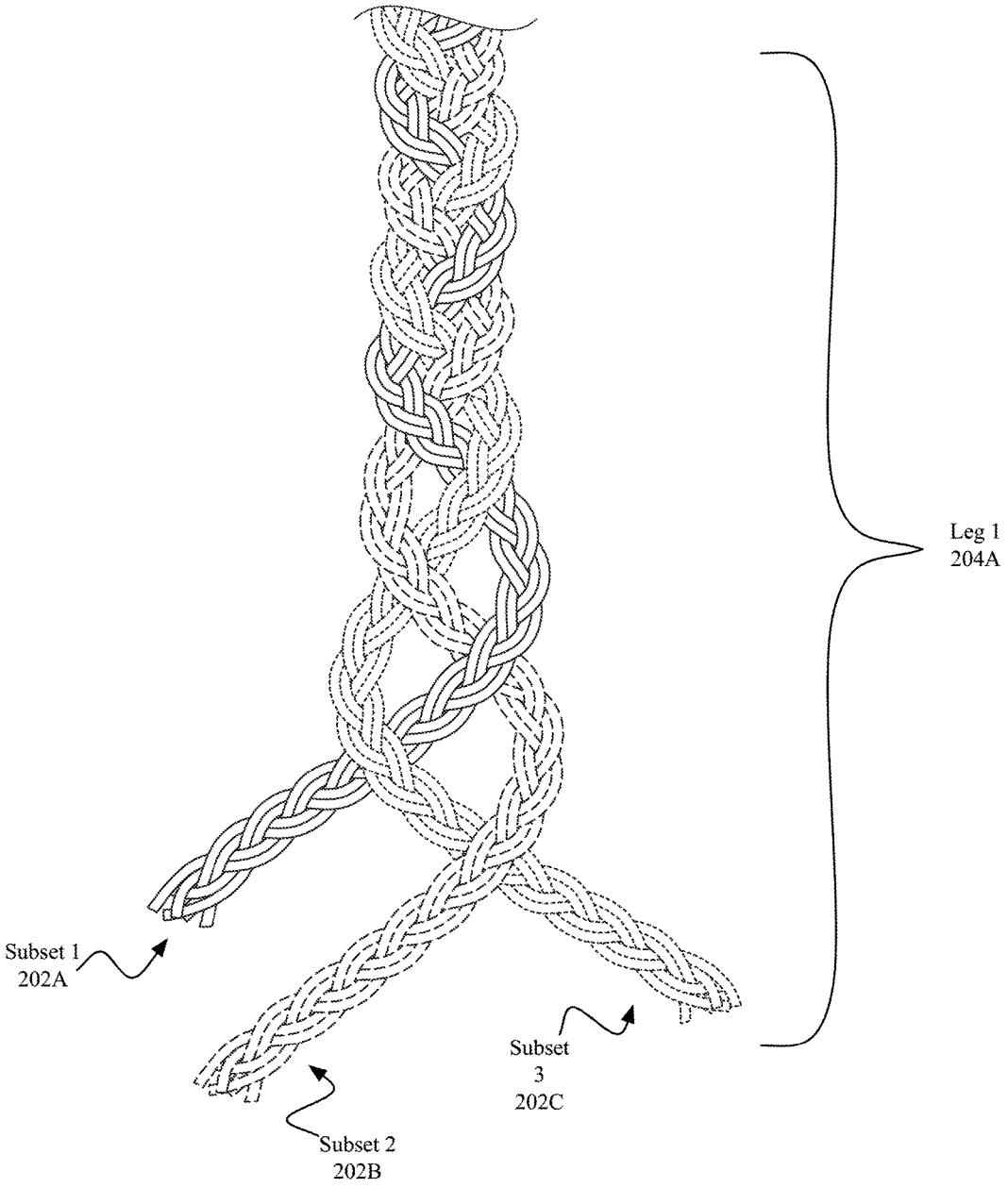
FIG. 2B is a diagram of an embodiment of a braid of three subsets of FIG. 2A for a low resistance, inductance, and capacitance cable.

As shown in FIG. 2B, a plurality of subsets 202A-202C of FIG. 2A may be woven or braided to form a leg 204A (referred to generally as leg(s) 204) of a low resistance, inductance, and capacitance multi-signal cable. Although illustrated with decreasing tightness towards the ends of subsets 202A-202C for clarity, in practice, the leg may be uniformly tight along substantially the entire length of the cable, excepting the terminal portion of each end. Although illustrated with three subsets 202A-202C, in some embodiments, additional subsets 202 may be added to the leg, and the leg may have any type of regular or complex topology. The overall leg may be flat or substantially flat, round, or have an oval or semi-circular cross section. Although illustrated with each subset 202A-202C identical in direction, in some embodiments, one or more of subsets 202 may be a reverse or inverse braid. For example, rather than braiding by passing a first pair 200A above a second pair 200B, the first pair may be passed below the second pair. The resulting subset 202 is electrically identical, but physically symmetric to a normal or non-inverse braid. Similarly, in some embodiments, subsets 202A-202C may be braided in a normal or inverse fashion to form a leg 204. In further embodiments, one or more of subsets 202A-202C may be braided in a first fashion, such as a normal braid, and may be braided in a second fashion, such as an inverse braid, to form a leg 204. In other embodiments, subsets 202A-202C may be formed of three pairs 200 as shown, while leg 204 may be formed of four or more subsets 202, or vice versa, such that the subsets and leg have different and asymmetric topologies.

Each conductor 201 of each pair 200 of a leg 204 may carry the same signal or same polarity of a signal, acting in concert as an equivalent conductor with a much lower gauge, reducing total resistance and signal attenuation. For example, with 18 individual conductors 201 (e.g. three braids of three pairs of conductors) of 0.022 inch diameter, the resulting leg 204 has an equivalent circular mil area (CMA) to an 11.5 AWG cable.

Figure 2C:
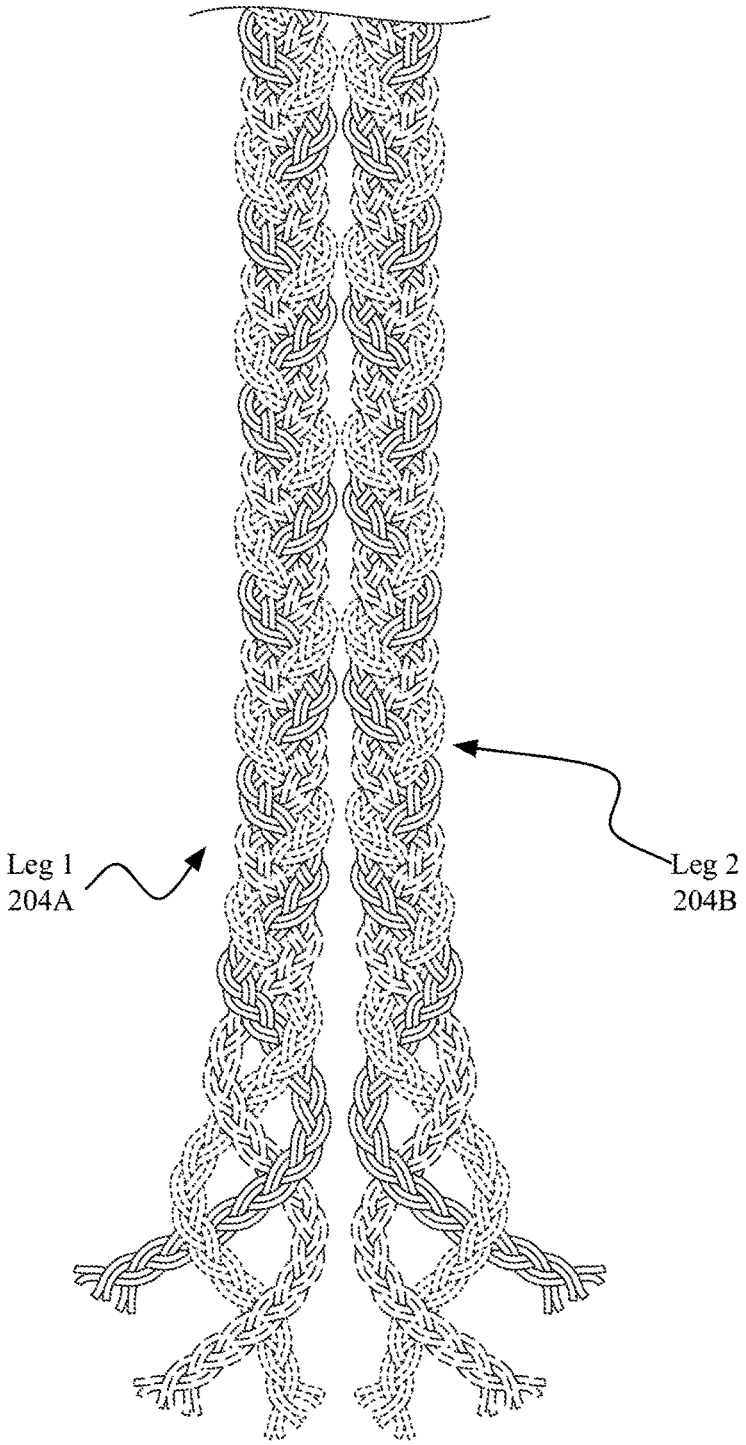
FIG. 2C is a diagram of an embodiment of two signal polarity carrying legs of FIG. 2B for a low resistance, inductance, and capacitance cable.

FIG. 2C is a diagram of an embodiment of two signal carrying legs 204A-204B of FIG. 2B for a low resistance, inductance, and capacitance cable. Each leg 204 may carry a single polarity of a signal. Because each conductor 201 crosses the entire width of its leg 204, over a long length of cable, the average transverse position of any one conductor 201 is the center of the leg, and the corresponding parasitic capacitance of the cable is approximately equal to a pair of parallel wires with distance d equal to the distance between the centers of each leg. This results in significantly lower capacitance than designs that use interwoven polarities of signals.

Inductance for the cable is also low. Within each leg, current flowing through each conductor 201 generate magnetic fields that roughly cancel each other, due to the close proximity of the conductors within each pair, and because of the geometry of the braid causing conductors to cross at near-perpendicular angles. Furthermore, because the currents through each leg have opposite polarities and the legs are very close to each other relative to the length of the cable, the resulting net magnetic fields of each leg also roughly cancel each other. This reduces overall inductance beyond implementations of typical cables with interwoven conductors of each polarity. In many implementations, the legs 204 may be braided symmetrically as shown to further reduce inductance through mutual cancellation of fields.

Figure 2D:
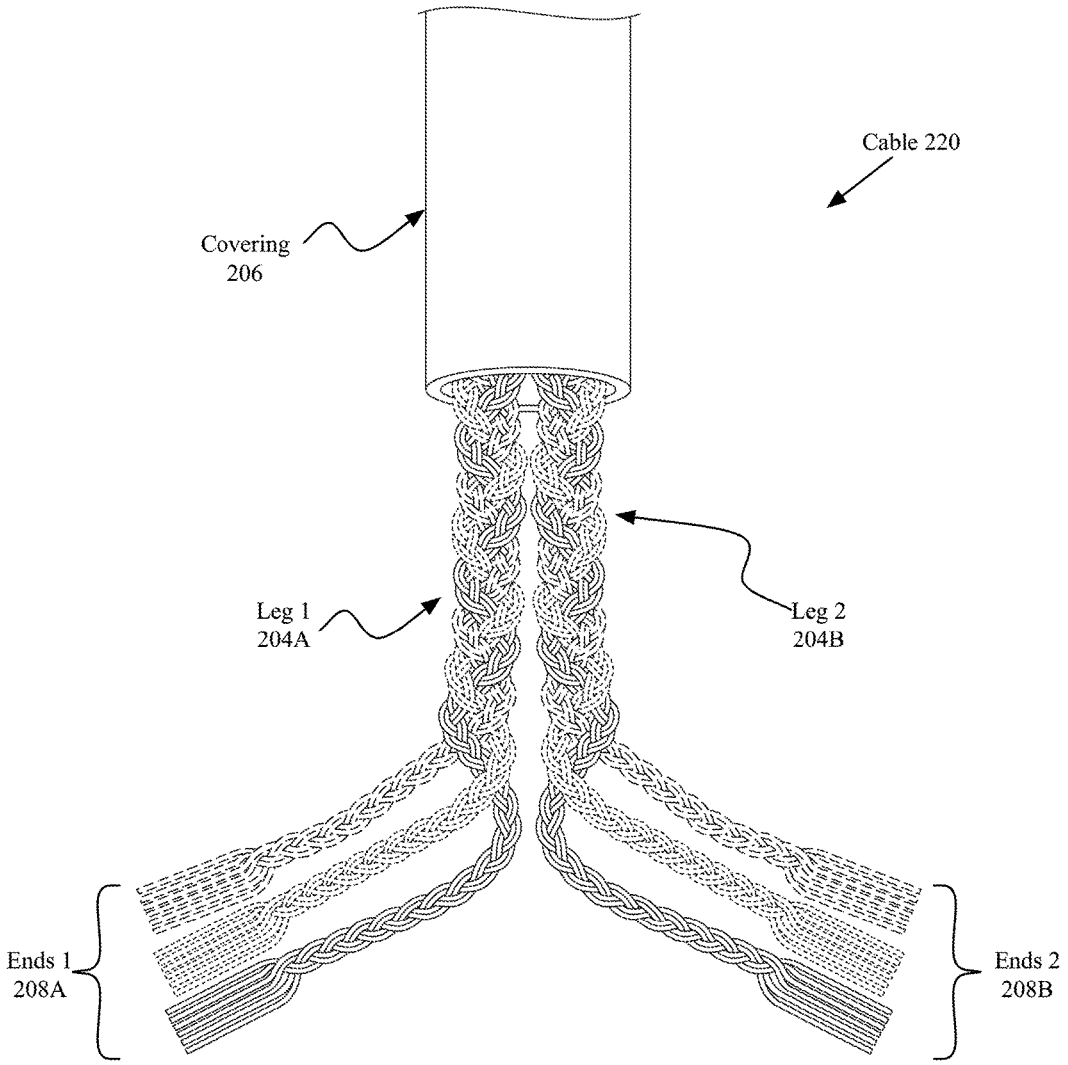
FIG. 2D is a diagram of an embodiment of a low resistance, inductance, and capacitance cable comprising two signal polarity carrying legs of FIG. 2C and a covering.

Referring briefly to FIG. 2D, illustrated is a diagram of an embodiment of a low resistance, inductance, and capacitance cable 220 comprising two signal polarity carrying legs 204A-204B of FIG. 2C and a covering 206. Each leg 204 may be unbraided at a terminal portion such that the individual conductors 201 of each leg are parallel at end portions 208A-208B (referred to generally as end(s) 208). This may allow each conductor 201 to be stripped of insulation at each end 208 and twisted or bonded together for a connector, such as a spade, pin, or banana connector or any other type of connector or plug; or connected to a binding post or similar attachment point. FIG. 2D is drawn with exaggerated lengths of legs 204A-204B extending from covering 206, unbraided lengths of each leg 204, and unbraided lengths of each subset 202 for clarity. In practice, these lengths may be significantly shorter, with covering 206 extending almost to ends 208.

Covering 206 may comprise any type and form of covering for legs 204 and may provide insulation and/or structural support. For example, covering 206 may comprise a low-cost spiral plastic or similar covering or split tubular wrap to hold legs 204 together. In other embodiments, covering 206 may comprise a fabric, Kevlar, polyester, nylon or any other material braid or mesh, providing a strong yet soft and flexible sleeve. In other embodiments, covering 206 may comprise an insulating sheath or jacket, and may comprise silicon, rubber, thermoplastic, PVC, Teflon, PE, PP, or any combination of these or other materials. For example, in one embodiment, covering 206 may comprise a plenum-rated jacket of low-smoke PVC, fluorinated ethylene polymer (FEP), PE or other thermoplastic polyolefins, or other such materials. In other embodiments, a textile thread or similar material may be woven through gaps between conductors 201 of legs 204A-204B, tying the legs 204 together. In such embodiments, covering 206 may not be needed for structure, and may be absent. Covering 206 or threads for binding or tying legs 204 together may be referred to generally as a securing material for securing the two legs in an adjacent configuration. Legs 204 may be held adjacent to each other, in parallel in the same plane or twisted around each other in a helix or otherwise held in close proximity to achieve cancellation of magnetic fields as discussed above.

Figure 2E:
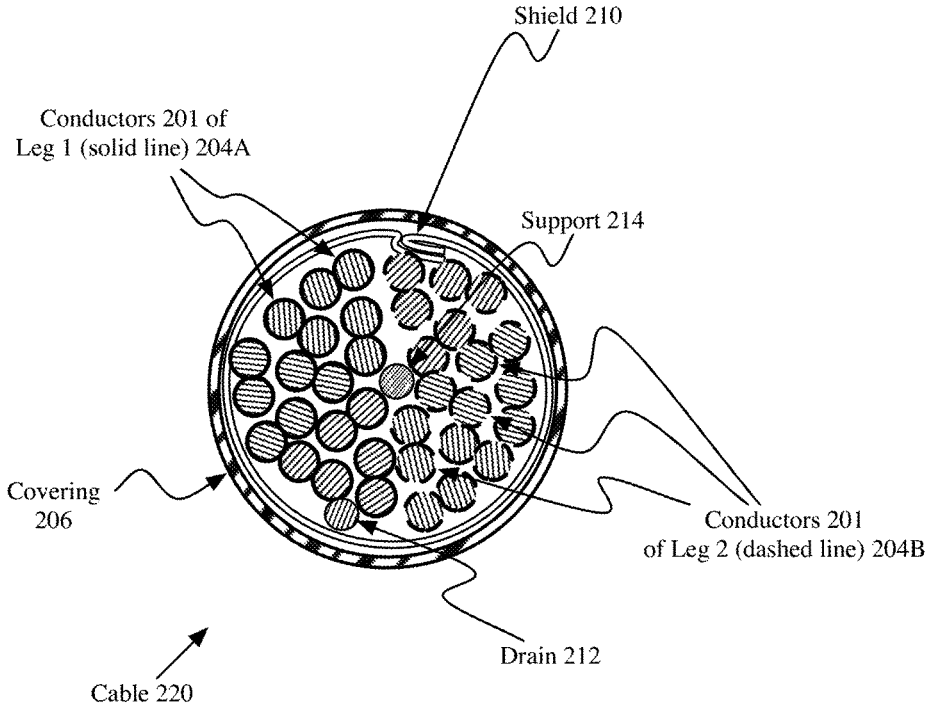
FIG. 2E is a diagram of a cross-section of an embodiment of the shielded low resistance, inductance, and capacitance cable of FIG. 2D.

FIG. 2E is a diagram of a cross-section of an embodiment of the low resistance, inductance, and capacitance cable 220 of FIG. 2D (not drawn to scale). Individual conductors 201 in pairs 200 of leg 204A are shown in solid line, while individual conductors 201 in pairs 200 of leg 204B are shown in dashed line. In many embodiments, the legs 204A-204B may comprise a semi-circular cross-section as shown, such that the two legs may be placed together to form an approximately circular cross-section cable as shown. This circular or round cross section of cable 220 may provide easier cable management and durability and improved electromagnetic interference (EMI) rejection over flat or ribbon-style cables.

The centroids of each leg 204A-204B are both near the center of the cable, with the result that magnetic fields of conductors of leg 204A and leg 204B are approximately of the same strength and opposite direction due to the opposite polarity of the signal carried by each leg, thus providing additional magnetic field cancellation and reducing the total inductance of the cable. Additionally, because the legs are close, induced currents due to external EMI (sometimes also referred to as radio frequency interference or RFI) are near identical in each leg, cancelling each other within the circuit through common-mode rejection and mostly eliminating such interference.

In some embodiments, the cable 220 may include a shield 210, which may comprise a copper or metallic braid, conductive foil shield, or other type of shield to absorb and discharge to ground external electrostatic charges or interference (ESI, sometimes also considered a subset of EMI). In embodiments employing a foil shield or similar shield that may be too fragile to solder or otherwise connect to a ground connector, the cable may include a conductive drain wire 212 in contact with shield 210. Drain wire 212 may be any type and form of conductor, including solid or stranded copper or silver or other material, and may be of any diameter. As ESI currents are typically small, drain wire 212 may be of relatively high gauge, such as 16, 18, 20 AWG or any other value. Shield 210 and drain wire 212 are optional and may be absent in many implementations.

In some embodiments, to provide structural support to the cable, one or more non-conductive supports 214 may be placed within the cable 220 and/or between conductors 201. The supports 214 may comprise nylon, polyester, cotton, or any other type and form of material, and may be used to provide additional tensile strength to the cable, for example to reduce the strain on conductors 201 when pulling the cable through a wall or conduit. Supports 214 may also provide internal structure to keep conductors 201 from moving within the cable, reducing microphonic noise. In such embodiments, one or more supports 214 may be placed around each leg 204 or between conductors 201 of a leg and the shield 210 or covering 206. Supports 214 may be of any size and shape, and in some embodiments may be referred to as cable filler elements. Supports 214 are optional and may not be included in many implementations. As discussed above, in some embodiments, supports 214 may also be woven through gaps between conductors 201 of each leg 204 and between each leg 204 to tie the legs together.

Although shown with 18 conductors 201 per leg 204, in some embodiments, each leg 204 may comprise only a single subset 202. This may reduce the number of conductors per leg to 6. In some such embodiments, each conductor 201 may have a lower gauge than discussed above, depending on the equivalent CMA required for the cable. Such reduced-conductor cables may be lower in cost to manufacture, while still having low capacitance and inductance. In other embodiments, each conductor 201 may have a high gauge, reducing the overall size of the cable. Although discussed being deployed as speaker cables, embodiments of the cables discussed herein may be used for other unbalanced or balanced signals, including line-level audio signals, instrument signals, microphone signals, or other uses. Accordingly, in many embodiments, the cables may be terminated with ¼" tip-sleeve (TS) or tip-ring-sleeve (TRS) connectors; RCA connectors; XLR connectors; or any other type and form of connector; or may be left unterminated, or pre-stripped and/or tinned for soldering. Additionally, although discussed with two legs carrying opposite polarities of a signal, in some embodiments, the cable may comprise multiple pairs of legs to transmit a number of distinct signals.

Figure 3:
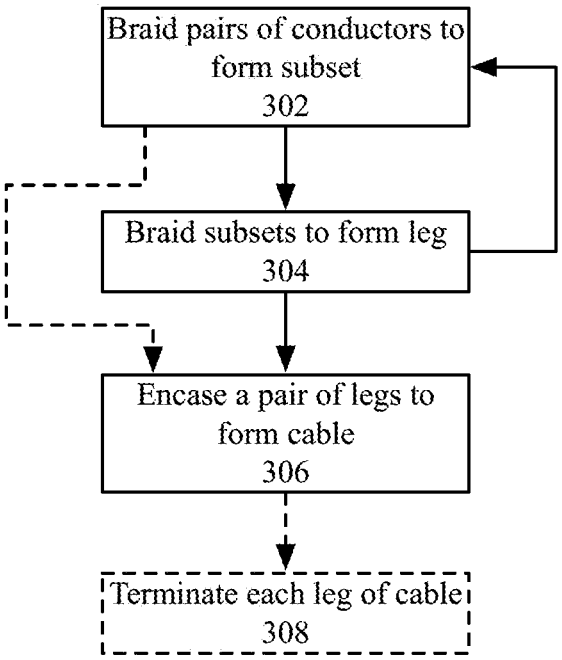
FIG. 3 is a flow chart of an embodiment of a method for constructing a low resistance, inductance, and capacitance cable.

FIG. 3 is a flow chart of an embodiment of a method for constructing a low resistance, inductance, and capacitance cable. At step 302, one or more pluralities of pairs of conductors may be individually braided to form a corresponding one or more subsets. The pairs of conductors may be individually insulated, may be bonded or unbonded, and may be twisted or parallel. The braid may comprise a simple or normal plait, an inverse or reverse plait, or a complex plait including a normal-inverse or alternating plait (sometimes referred to as a Dutch plait), a spiral plait, or any other type or form of braid. Different subsets may be braided in different fashions.

At step 304, in some embodiments, two or more pluralities of subsets may be individually braided to form a corresponding two or more legs. Each subset may comprise a simple or normal plait, an inverse or reverse plait, or a complex plait including a normal-inverse or alternating plait (sometimes referred to as a Dutch plait), a spiral plait, or any other type and form of braid. In many embodiments, each leg may comprise identical braids, while in other embodiments, a first leg may have an inverse braid from a corresponding second braid. As shown, in some embodiments, steps 302-304 may be repeated to form each leg in series. Similarly, step 302 may be repeated in series to form each subset for braiding at step 304. In other embodiments, multiple instances of step 302 and/or step 304 may performed simultaneously or in parallel, to speed manufacturing.

At step 306, one or more pairs of legs may be encased or sheathed or tied together to form a cable. In some embodiments shown in dashed line, step 304 may be skipped such that each leg comprises a single subset, as discussed above. The legs may be parallel, and in some embodiments, may be twisted in a helix. Each leg may carry a single polarity signal, with a pair of legs of the cable carrying opposing polarities of the signal. Encasing or sheathing the cable may further comprise shielding or enclosing the legs in a conductive shield or braid; may include encasing a drain wire contacting a conductive shield; and/or may comprise encasing one or more supports or filler threads within or around the legs.

In some embodiments, at step 308 in dashed line, the legs may be terminated. In such embodiments, an unbraided end portion of the conductors of each subset of each leg may be stripped of insulation or have insulation not applied to said individual conductors at the end portion. The uninsulated portions of each conductor of each leg may be twisted together or otherwise bonded. The bonded uninsulated portions of conductors of each leg may be connected to a connector, plug or attachment point, with each leg kept electrically isolated. In other embodiments, the legs may be left unterminated and step 308 may be skipped.

As discussed above, typical cable designs have a trade-off between inductance and capacitance, with designers attempting to minimize one (frequently inductance) at the expense of the other. Illustrated in FIGS. 4A-4F are charts of measured inductance and capacitance for several typical reference cables, showing this trade-off.

Figure 4A:
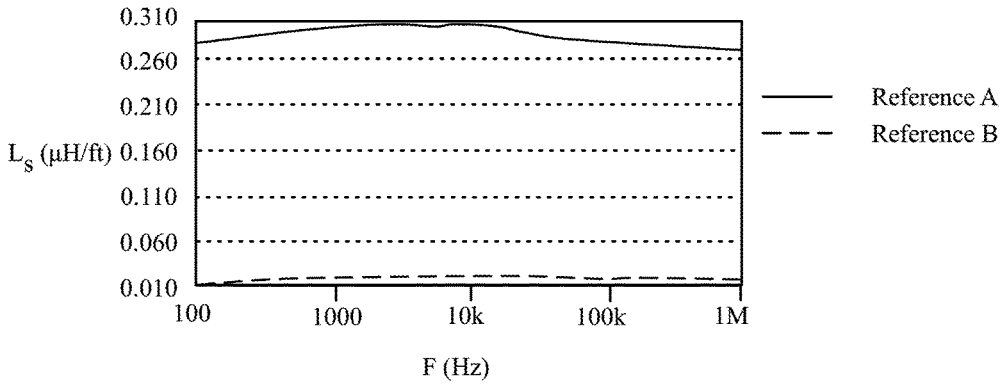
FIGS. 4A and 4B are charts of measured inductance and capacitance, respectively, for two reference cables.
Figure 4B:
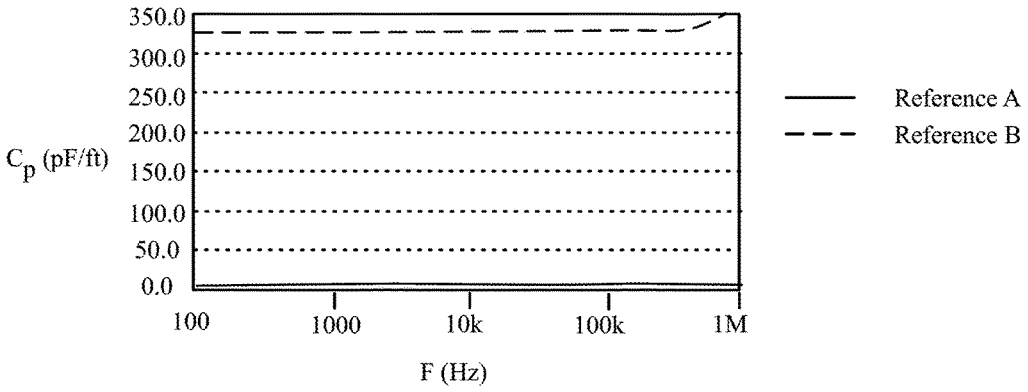

For example, referring first to FIGS. 4A and 4B, measured inductance and capacitance are shown, respectively, for two reference cables, 10AWG Master Series Silver Copper speaker cable from Acoustic Research, a division of Voxx International Corp. of Hauppauge, N.Y. (Reference A); and MI-2 Veracity cable from Goertz Audio, a division of Bridgeport Magnetics Group, Inc. of Shelton, Conn. (Reference B). The Reference A cable comprises two parallel legs of multi-stranded insulated conductors with an effective conductor area of 10AWG, with a 6 mm spacer between each leg. The Reference B cable comprises two legs of multi-stranded insulated conductors arranged as two flat parallel ribbons. The measured values are listed below in Table 2A with inductance $L_s$, resistance $R_s$, and parasitic inductance $C_p$:

TABLE 2A

| | Brand | | | | | |
|---|---|---|---|---|---|---|
| | Acoustic Research | | | Goertz | | |
| | Model | | | | | |
| | Speaker Cable | | | MI-2 Veracity | | |
| Frequency (Hz) | $L_s$ (μH/ft.) | $R_s$ (mΩ/ft.) | $C_p$ (pF/ft.) | $L_s$ (μH/ft.) | $R_s$ (mΩ/ft.) | $C_p$ (pF/ft.) |
| 100 | 0.2773 | 2.27 | 7.5 | 0.014 | 3.08 | 328 |
| 1000 | 0.297 | 2.23 | 7.1 | 0.021 | 3.08 | 327 |
| 2500 | 0.299 | 2.26 | 6.9 | 0.021 | 3.08 | 327 |

TABLE 2A-continued

| | Brand | | | | | |
|---|---|---|---|---|---|---|
| | Acoustic Research | | | Goertz | | |
| | Model | | | | | |
| | Speaker Cable | | | MI-2 Veracity | | |
| Frequency (Hz) | $L_s$ (μH/ft.) | $R_s$ (mΩ/ft.) | $C_p$ (pF/ft.) | $L_s$ (μH/ft.) | $R_s$ (mΩ/ft.) | $C_p$ (pF/ft.) |
| 5000 | 0.297 | 2.33 | 6.7 | 0.021 | 3.09 | 327 |
| 7500 | 0.298 | 2.42 | 6.6 | 0.021 | 3.09 | 327 |
| 10000 | 0.295 | 2.51 | 6.6 | 0.021 | 3.1 | 327 |
| 15000 | 0.296 | 2.87 | 6.5 | 0.021 | 3.12 | 327 |
| 20000 | 0.293 | 3.21 | 6.4 | 0.021 | 3.13 | 327 |
| 50000 | 0.282 | 4.4 | 6.2 | 0.021 | 3.2 | 327 |
| 100000 | 0.279 | 6.56 | 6 | 0.02 | 3.55 | 328 |
| 500000 | 0.271 | 19.7 | 5.6 | 0.019 | 7.1 | 333 |
| 1000000 | 0.269 | 26 | 5.4 | 0.018 | 9.6 | 381 |

Source: "Speaker Cable Faceoff 2—Measurements Part 1", Gene DellaSala, Audioholics Online A/V Magazine (Aug. 29, 2004), available at: http://www.audioholics.com/reviews/cables/speaker-cable-reviews-faceoff-2/speaker-cable-reviews-faceoff-2-page-6

As shown, the Reference A cable has low capacitance, but very high inductance per foot. Conversely, the Reference B cable minimizes inductance, but at the expense of very high capacitance. Additionally, the manufacturer of the Reference B cable terminates the cable with a Zobel network to prevent amplifier damage and oscillations.

Figure 4C:
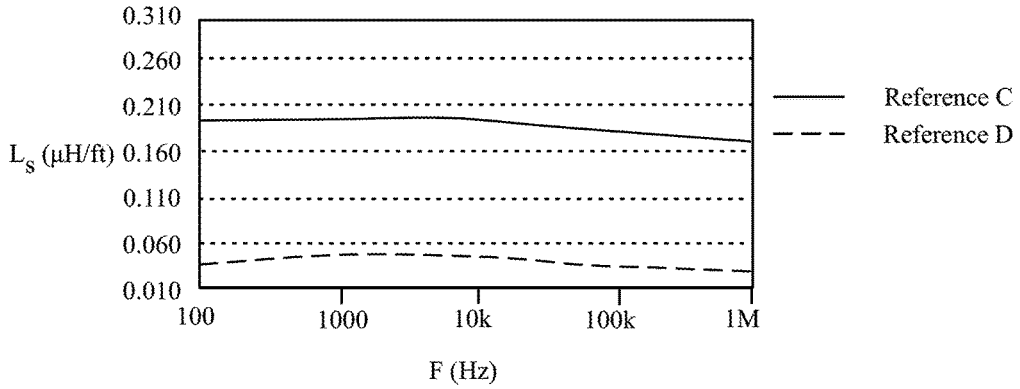
FIGS. 4C and 4D are charts of measured inductance and capacitance, respectively, for another two reference cables.
Figure 4D:
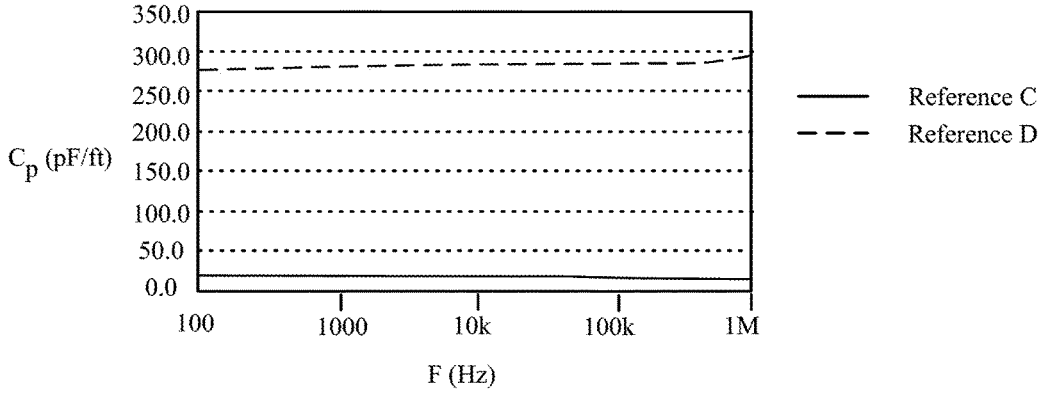

Referring next to FIGS. 4C and 4D, measured inductance and capacitance are shown, respectively, for two additional reference cables, speaker cable from AV Cable of Canal Winchester, Ohio (Reference C); and SE 9 cable from Cardas Audio of Bandon, Oreg. (Reference D). Reference C comprises standard zip cord, or two parallel legs of twisted un-insulated copper conductors. Reference D comprises a high number of individually insulated conductors arranged with two coaxial legs. The measured values are listed below in Table 2B with inductance $L_s$, resistance $R_s$, and parasitic inductance $C_p$:

TABLE 2B

| | Brand | | | | | |
|---|---|---|---|---|---|---|
| | AV Cable | | | Cardas | | |
| | Model | | | | | |
| | Speaker Cable | | | SE 9 | | |
| Frequency (Hz) | $L_s$ (μH/ft.) | $R_s$ (mΩ/ft.) | $C_p$ (pF/ft.) | $L_s$ (μH/ft.) | $R_s$ (mΩ/ft.) | $C_p$ (pF/ft.) |
| 100 | 0.194 | 2.2 | 20 | 0.039 | 2.58 | 278 |
| 1000 | 0.195 | 2.19 | 18.7 | 0.05 | 2.59 | 283 |
| 2500 | 0.195 | 2.2 | 18.3 | 0.05 | 2.61 | 285 |
| 5000 | 0.195 | 2.25 | 17.9 | 0.049 | 2.67 | 285 |
| 7500 | 0.194 | 2.33 | 17.6 | 0.048 | 2.77 | 285 |
| 10000 | 0.194 | 2.43 | 17.4 | 0.048 | 2.87 | 285 |
| 15000 | 0.193 | 2.67 | 17.2 | 0.046 | 3.13 | 285 |
| 20000 | 0.191 | 2.93 | 16.9 | 0.045 | 3.38 | 285 |
| 50000 | 0.187 | 4.35 | 16.2 | 0.04 | 4.57 | 285 |
| 100000 | 0.184 | 6.9 | 15.6 | 0.036 | 6.2 | 285 |
| 500000 | 0.174 | 27.5 | 14.3 | 0.033 | 15.7 | 285 |
| 1000000 | 0.172 | 48.5 | 13.6 | 0.031 | 24.4 | 296 |

Source: "Speaker Cable Faceoff 2—Measurements Part 1", Gene DellaSala, Audioholics Online A/V Magazine (Aug. 29, 2004), available at: http://www.audioholics.com/reviews/cables/speaker-cable-reviews-faceoff-2/speaker-cable-reviews-faceoff-2-page-6

Although values for References C and D are less extreme than values for References A and B, the same trade-off of high inductance and low capacitance, or high capacitance and low inductance may be observed.

Figure 4E:
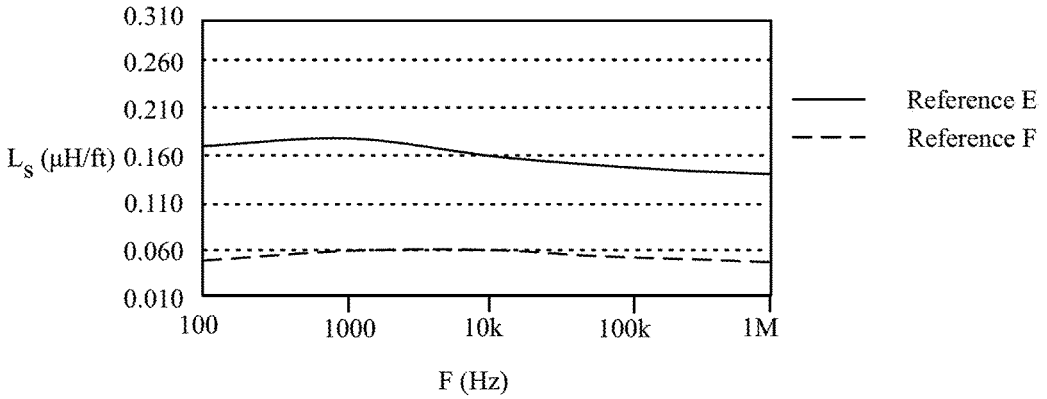
FIGS. 4E and 4F are charts of measured inductance and capacitance, respectively, for still another two reference cables.
Figure 4F:
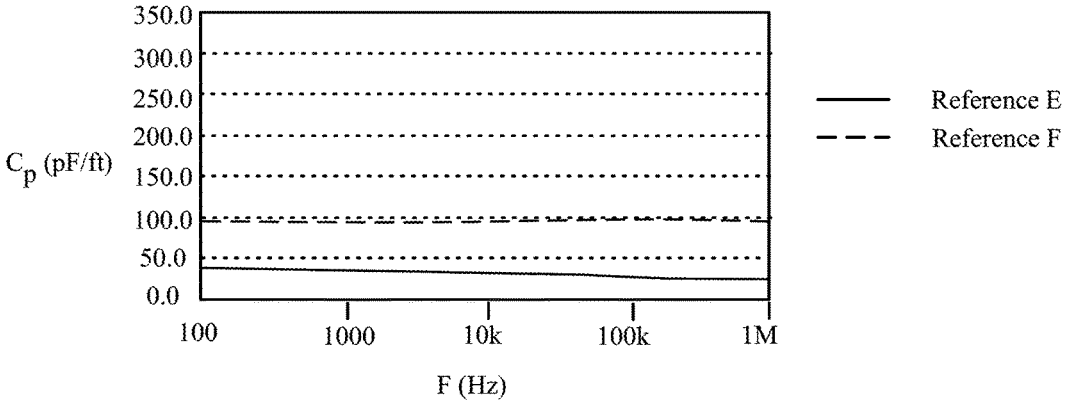

Finally, FIGS. 4E and 4F illustrate measured inductance and capacitance, respectively, for another two additional reference cables, Flexygy 6 cable from River Cable of Hudson, N.Y. (Reference E); and Clarity7 cable from Empirical Audio of Black Butte Ranch, Oreg. (Reference F). Reference E comprises two parallel legs of three individually insulated conductors each, arranged as a flat ribbon. Reference F comprises two parallel legs of seven twisted pairs of un-insulated conductors spaced in an air dielectric. The measured values are listed below in Table 2C with inductance $L_s$, resistance $R_s$, and parasitic inductance $C_p$:

TABLE 2C

| | Brand | | | | | |
|---|---|---|---|---|---|---|
| | Flexygy 6 | | | Clarity7 | | |
| | Model | | | | | |
| | River Cable | | | Empirical Audio | | |
| Frequency (Hz) | $L_s$ (μH/ft.) | $R_s$ (mΩ/ft.) | $C_p$ (pF/ft.) | $L_s$ (μH/ft.) | $R_s$ (mΩ/ft.) | $C_p$ (pF/ft.) |
| 100 | 0.172 | 2.83 | 41.5 | 0.049 | 3.24 | 98 |
| 1000 | 0.178 | 2.86 | 38.5 | 0.062 | 3.21 | 97.6 |
| 2500 | 0.174 | 2.97 | 36.9 | 0.062 | 3.24 | 97.6 |
| 5000 | 0.168 | 3.22 | 35.8 | 0.062 | 3.28 | 97.4 |
| 7500 | 0.163 | 3.45 | 35.1 | 0.061 | 3.36 | 97.4 |
| 10000 | 0.159 | 3.6 | 34.5 | 0.06 | 3.45 | 97.3 |
| 15000 | 0.156 | 3.84 | 33.8 | 0.059 | 3.61 | 97.3 |
| 20000 | 0.154 | 4.02 | 33.2 | 0.058 | 3.8 | 97.2 |
| 50000 | 0.151 | 5.11 | 31.3 | 0.055 | 4.72 | 97.1 |
| 100000 | 0.148 | 7.46 | 30 | 0.053 | 6.4 | 96.9 |
| 500000 | 0.142 | 24.8 | 27.3 | 0.052 | 27.2 | 96.8 |
| 1000000 | 0.138 | 49.5 | 26.8 | 0.049 | 50.6 | 96.6 |

Source: "Speaker Cable Faceoff 2—Measurements Part 1", Gene DellaSala, Audioholics Online A/V Magazine (Aug. 29, 2004), available at: http://www.audioholics.com/reviews/cables/speaker-cable-reviews-faceoff-2/speaker-cable-reviews-faceoff-2-page-6

As with References A and B, and Reference C and D, References E and F illustrate the same trade-off of high inductance and low capacitance, or high capacitance and low inductance.

Figure 5A:
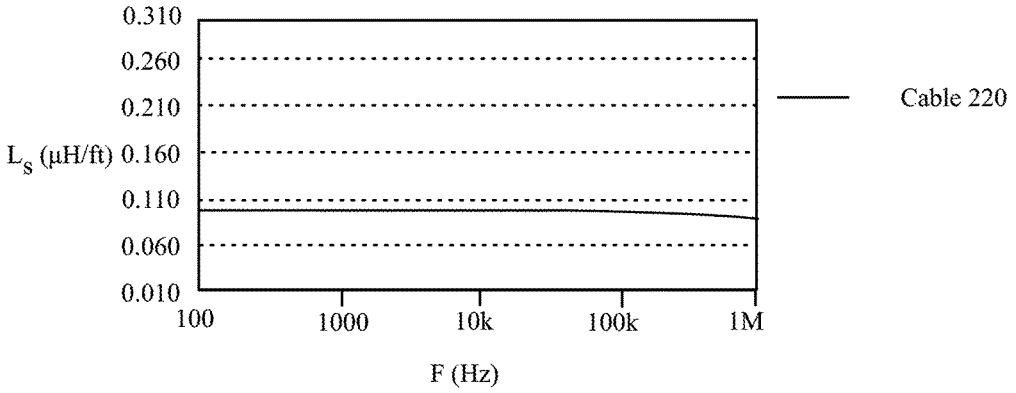
FIGS. 5A and 5B are charts of measured inductance and capacitance, respectively, for an embodiment of a low resistance, inductance, and capacitance cable.
Figure 5B:
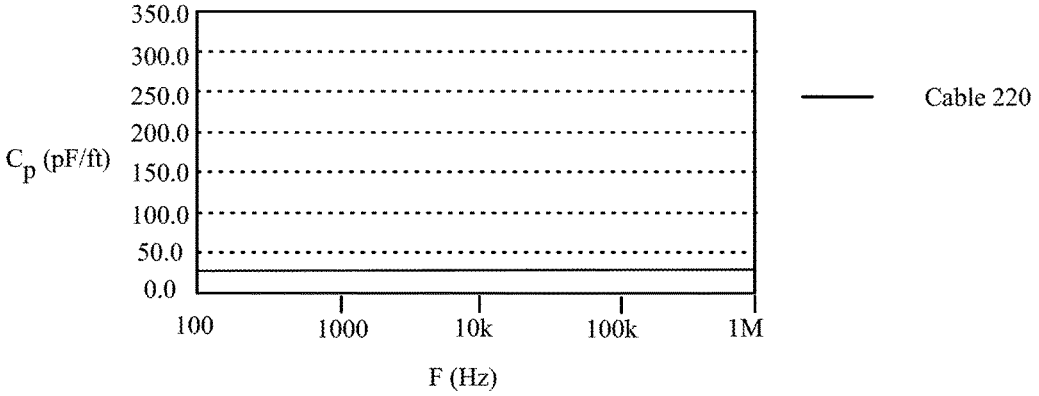

Turning now to FIGS. 5A and 5B, illustrated are charts of measured inductance and capacitance, respectively, for an embodiment of a low resistance, inductance, and capacitance cable 220 as described above in connections with FIGS. 2A-2E and 3. In particular, the measured embodiment comprised 36 0.0208" diameter (24 AWG) individually insulated conductors, configured as two parallel legs of three braided subsets of three braided pairs of bonded parallel conductors. Measured values are listed below in Table 2D with inductance $L_s$, resistance $R_s$, and parasitic inductance $C_p$:

TABLE 2D

| | Cable 220 | | |
|---|---|---|---|
| Frequency (Hz) | $L_s$ (μH/ft.) | $R_s$ (mΩ/ft.) | $C_p$ (pF/ft.) |
| 20 | 0.118 | 3.505 | 25.086 |
| 50 | 0.107 | 3.607 | 25.317 |
| 100 | 0.106 | 3.849 | 25.403 |
| 250 | 0.101 | 2.837 | 25.438 |

TABLE 2D-continued

| | Cable 220 | | |
|---|---|---|---|
| Frequency (Hz) | $L_s$ (μH/ft.) | $R_s$ (mΩ/ft.) | $C_p$ (pF/ft.) |
| 500 | 0.100 | 3.024 | 25.485 |
| 1000 | 0.101 | 3.407 | 25.629 |
| 2500 | 0.101 | 3.890 | 25.639 |
| 5000 | 0.100 | 3.947 | 25.642 |
| 7500 | 0.100 | 3.965 | 25.644 |
| 10000 | 0.100 | 3.954 | 25.637 |
| 15000 | 0.100 | 3.933 | 25.638 |
| 20000 | 0.099 | 4.106 | 25.644 |
| 50000 | 0.098 | 4.555 | 25.639 |
| 100000 | 0.097 | 5.425 | 25.641 |
| 500000 | 0.091 | 10.244 | 25.644 |
| 1000000 | 0.089 | 13.745 | 25.768 |

As shown above and illustrated in FIGS. 5A and 5B, the cable 220 has significantly lower inductance than any low capacitance cable such as References A, C, or E (and lower inductance than Reference E); and significantly lower capacitance than any low inductance cable, such as References B, D, and F. Additionally, due to the narrow diameters of individual conductors within cable 220, resistance at high frequencies due to skin effect is reduced compared to References A-F.

Additionally, as discussed above, capacitance affects phase distortion, with high capacitances in cables lowering the $f_c$ cut-off frequency of the RC low-pass filter equivalent to the cable. The low capacitances provided by embodiments of cable 220 allow for much higher $f_c$, reducing or eliminating any audible phase distortion. For example, as discussed above, given a 47 nF/ft. speaker cable of a long length of 213 feet, there are 45 degrees of phase shift at 10 kHz, with 10 degrees of phase shift at only 1750 Hz, easily within the audible range. Given the same 213 foot cable run, but utilizing an embodiment of cable 220 with a capacitance of 26.2 pF/ft. as shown above in Table 2D, there are only 8 degrees of phase shift at 10 kHz and 10 degrees of phase shift at 13 kHz. The cable does not reach 45 degrees of phase shift until over 70 kHz. Accordingly, with typical lengths of embodiments of cable 220, phase distortion is significantly flat across the majority of the audible range.

Accordingly, embodiments of the cable and manufacturing techniques described herein provide a low capacitance, low inductance, low resistance cable with a round cross-section for durability and improved common-mode EMI rejection, preserving phase and arrival time accuracy of signals across the audible range. No filters or Zobel networks are required to prevent oscillations and amplifier damage. Capacitance is reduced via separation of the average positions of conductors in legs carrying single-polarity signals, while inductance is reduced due to magnetic field cancellations from both close spacing and geometry of conductors within each leg and close spacing and geometries of the legs. Embodiments of the cable may be used for speakers, instruments, microphones, or other signals, and may include both the braid of braided subunits illustrated in FIG. 2C or a single braided subunit, in implementations requiring smaller overall diameters or reduced manufacturing costs.

The above description in conjunction with the above-reference drawings sets forth a variety of embodiments for exemplary purposes, which are in no way intended to limit the scope of the described methods or systems. Those having skill in the relevant art can modify the described methods and systems in various ways without departing from the broadest scope of the described methods and systems. Thus, the scope of the methods and systems described herein should not be limited by any of the exemplary embodiments and should be defined in accordance with the accompanying claims and their equivalents.

What is claimed:

1. A method for constructing a cable, comprising:

simultaneously braiding a first nine pairs of insulated conductors into a first leg of three braided subsets of three pairs of insulated conductors; and simultaneously braiding a second nine pairs of insulated conductors into a second leg of three braided subsets of three pairs of insulated conductors, the first leg separate from the second leg.

2. The method of claim 1, further comprising securing the first leg and second leg adjacent to each other with a securing material.

3. The method of claim 1, further comprising encapsulating the two legs in a conductive braid.

4. The method of claim 1, further comprising wrapping the two legs in a conductive foil.

5. The method of claim 1, further comprising securing the two legs adjacent to a drain wire.

6. The method of claim 1, wherein simultaneously braiding the first nine pairs and simultaneously braiding the second nine pairs are also performed simultaneously.

7. The method of claim 1, wherein simultaneously braiding the first nine pairs and simultaneously braiding the second nine pairs are performed sequentially.

8. A cable, comprising a first plurality of braided insulated conductors; and a second plurality of braided insulated conductors; adjacent to and separate from the first plurality of braided insulated conductors, wherein the first plurality and the second plurality of braided insulated conductors each comprise a braid of three sets of conductors, and wherein each of the three sets of conductors comprise a braid of three pairs of insulated conductors.

9. The cable of claim 8, wherein each pair of insulated conductors comprises a bonded pair of insulated conductors.

10. The cable of claim 8, wherein each pair of insulated conductors comprises an untwisted pair of insulated conductors.

11. The cable of claim 8, further comprising a conductive braid surrounding the first plurality and second plurality of braided insulated conductors.

12. The cable of claim 8, further comprising a conductive foil surrounding the first plurality and second plurality of braided insulated conductors.

13. The cable of claim 8, further comprising a securing material surrounding the first plurality and second plurality of braided insulated conductors.

14. The cable of claim 13, wherein the securing material comprises a spiral wrap.

15. The cable of claim 8, wherein each conductor is surrounded by a fluorinated ethylene propylene (FEP) insulation.

16. The cable of claim 8, wherein the cross section of the cable is substantially round.

* * * * *